US005174322A

United States Patent [19]

Melrose

[11] Patent Number: 5,174,322

[45] Date of Patent: Dec. 29, 1992

[54] AUTOMATIC TWO-POSITION FOUR-WAY PULSATING VALVE

[75] Inventor: Clayton A. Melrose, Oakes, N. Dak.

[73] Assignee: Town & Country Research & Development, Inc., Marion, N. Dak.

[21] Appl. No.: 665,837

[22] Filed: Mar. 7, 1991

[51] Int. Cl.[5] ..... F15B 13/042

[52] U.S. Cl. ..... 137/106; 91/306; 91/312; 91/318

[58] Field of Search ..... 91/306, 312, 318; 137/106

[56] References Cited

U.S. PATENT DOCUMENTS 551,366 12/1895 Cornwall ..... 91/318 X 4,449,896 5/1984 Klepper et al. .

*Primary Examiner*—Gerald A. Michalsky

*Attorney, Agent, or Firm*—James R. Young

[57] ABSTRACT

A four-way hydraulic control valve automatically reverses flow of hydraulic fluid to a double acting hydraulic cylinder or to a reversible hydraulic motor when a substantial resistance to fluid flow is encountered, such as when the cylinder or a machine being operated by the cylinder or motor reaches a mechanical limit of its motion. The valve has a reciprocating spool in a valve body with two internal control valves, one at each end, and with appropriate internal pressure shunts for directing high pressure fluid into the control valves and drain fluid restrictions to shuttle the spool back and forth in response to an increase in pressure resulting from a substantial resistance to fluid flow.

5 Claims, 10 Drawing Sheets

AUTOMATIC TWO-POSITION FOUR-WAY PULSATING VALVE

BACKGROUND OF THE INVENTION

1. Field of the Invention

The present invention relates generally to hydraulic control valves, and more specifically to a pulsating hydraulic valve for causing and controlling reciprocal action of a hydraulic cylinder.

2. State of the Prior Art

There are many applications for hydraulic cylinders wherein continuous reciprocating motion is required. Essentially, a hydraulic cylinder is a common generic term for a linear hydraulically driven actuator comprising a cylindrical housing with a piston positioned slideably in the housing. A piston rod attached to the piston extends through appropriate seals out one end, the rod end, of the cylindrical housing, and the opposite or blind end of the cylindrical housing is usually enclosed, although some hydraulic cylinders have rods extending out both ends of the cylindrical housing. Hydraulic fluid inlet and outlet ports are positioned on opposite sides of the piston for admitting hydraulic fluid under pressure into the cylinder and allowing the fluid to escape the cylinder. Of course, pressurized hydraulic fluid flowing into the cylinder on one side of the piston forces the piston to move in the opposite direction, and the piston rod can be connected to any apparatus desired to be moved. Such hydraulic cylinders with fluid ports positioned at opposite ends, i.e., on both sides of the piston, as described above, are commonly called double acting cylinders. Reciprocal motion of the piston rod in a double acting cylinder is caused by alternately directing pressurized hydraulic fluid into the cylinder on one side of the piston and then on the other side.

Common hydraulic control valves have spools with annular cavities in their peripheral surfaces positioned slideably inside bores in valve housings. The spool shuttles back and forth to open and close selected ports in the valve housing. For example, in one spool position, a cavity in the spool can connect a port delivering pressurized hydraulic fluid with a port directed to one end of a double acting cylinder while simultaneously connecting a port from the opposite end of the cylinder with a drain or conduit to a hydraulic fluid reservoir or tank. Thus, pressurized hydraulic fluid is directed by the control valve to one side of the piston causing movement of the piston and rod in the one direction while allowing hydraulic fluid from the opposite side of the piston to escape by draining to the tank. Alternately, shifting or shuttling the spool to a different position could connect the opposite cylinder ports to high pressure fluid and tank, respectively, to cause the piston and rod to move in the opposite direction.

Shifting or shuttling the spool from one position to the other, as described above, usually just involve moving it longitudinally within the valve bore. Such shuttling can be actuated or accomplished by a hand-operated lever connected to the spool, a solenoid actuator, or even hydraulic actuators that apply hydraulic fluid pressure to one end or the other of the spool.

The problem with those conventional shuttle valve control devices when reciprocating motion is required, especially over extended periods of time, is that they require some kind of external control devices. A solenoid-actuated valve requires electric switches, either position-actuated by sensing the physical position of a part or pressure actuated by sensing hydraulic pressure in various portions of the hydraulic system. Fluid actuated valves also require some kind of equipment position sensors and external valving apparatus. Over extended periods of time, these kinds of external shuttle control actuators or control devices tend to wear out, break down, or otherwise become unreliable or require maintenance. They also add significantly to the manufacturing costs of reciprocating hydraulic devices.

SUMMARY OF THE INVENTION

Accordingly, a general object of the present invention is to provide a more reliable and cost effective reciprocating hydraulic control valve.

A more specific object of this invention is to provide a self-contained, internally controlled automatic two-position four-way pulsating valve for causing reciprocal operations of a hydraulic cylinder.

Additional objects, advantages, and novel features of the invention shall be set forth in part in the description that follows, and in part will become apparent to those skilled in the art upon examination of the following or may be learned by the practice of the invention. The objects and the advantages of the invention may be realized and attained by means of the instrumentalities and in combinations particularly pointed out in the appended claims.

To achieve the foregoing and other objects and in accordance with the purpose of the present invention, as embodied and broadly described herein, the apparatus of this invention may comprise a reciprocating spool in a valve body that has two internal control valves at each end with appropriate internal pressure shunts for high pressure fluid into the control valves and drain fluid restrictions to shuttle the spool back and forth in response to the piston in the cylinder reaching the end of its movement.

BRIEF DESCRIPTION OF THE DRAWINGS

The accompanying drawings, which are incorporated herein and form a part of the specification illustrate preferred embodiments of the present invention, and together with the description, serve to explain the principles of the invention. In the drawings.

DETAILED DESCRIPTION OF THE PREFERRED EMBODIMENTS

Figure 1:
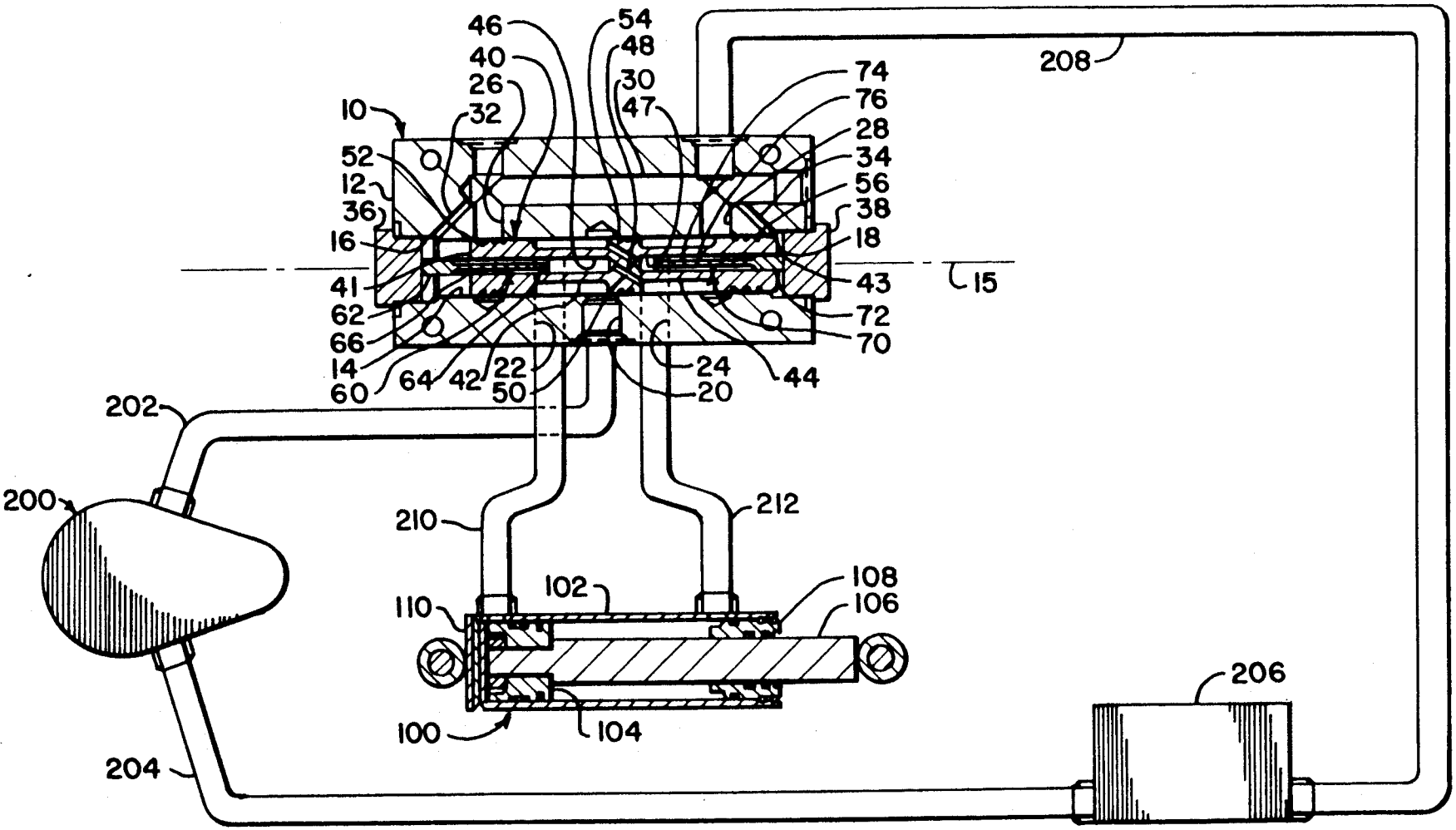
FIG. 1 is a cross-sectional view of the pulsating valve of the present invention connected to a pump, reservoir, and hydraulic cylinder, the shuttle spool in the pulsating valve being shown in the first position to direct fluid under pressure to the cylinder to start extension of the cylinder.

The pulsating valve 10 according to the present invention, as shown in FIG. 1, is connected to a hydraulic cylinder 100 in a manner that controls and causes hydraulic cylinder 100 to extend and retract its piston rod 106 in a reciprocal manner, as will be described in more detail below. The pulsating valve 10 is also shown connected to a hydraulic fluid pump 200 and to a hydraulic fluid reservoir 206, as will also be described in more detail below.

Essentially, the pulsating valve 10 includes a valve body 12 that has a spool bore 14 extending therethrough, which bore 14 defines a longitudinal axis 15. A shuttle spool 40 is slideably positioned in the spool bore 14 such that it is moveable back and forth from one end 16 of the bore 14 to the other end 18 for the purpose of directing flow of hydraulic fluids through the valve, as will be described in more detail below. The first end 16 of the spool bore 14 is closed by a plug 36, and the second end 18 of the spool bore 14 is closed by a second plug 38. As the shuttle spool 40 moves back and forth in the spool bore 14, it directs hydraulic fluid under pressure from the pump 200 alternately to the blind end 110 of the cylinder 100 to extend piston rod 106, and then alternately to the rod end 108 of the cylinder 100 to retract the piston rod 106 in a reciprocal manner.

As shown in FIG. 1, the shuttle spool 40 is in the first position with its second end 43 adjacent the second plug 38. In this first position, an annular cavity 42 recessed into the peripheral surface of the spool 40 spans and connects the pressure port 20 and the first feed port 22. At the same time, a second annular cavity 44 recessed into the peripheral surface of the spool 40 spans and connects the second feed port 24 with the second drain port 28. The first drain port 26 is effectively blocked and closed off by the peripheral surface of the spool 40.

In this first position, hydraulic fluid under pressure flows from the pump 200 through conduit 202 into pressure port 20, through cavity 42 and out first feed port 22. From first feed port 22, the hydraulic fluid under pressure continues through conduit 210 into the blind end 110 of hydraulic cylinder 100, essentially on one side of piston 104.

Figure 2:
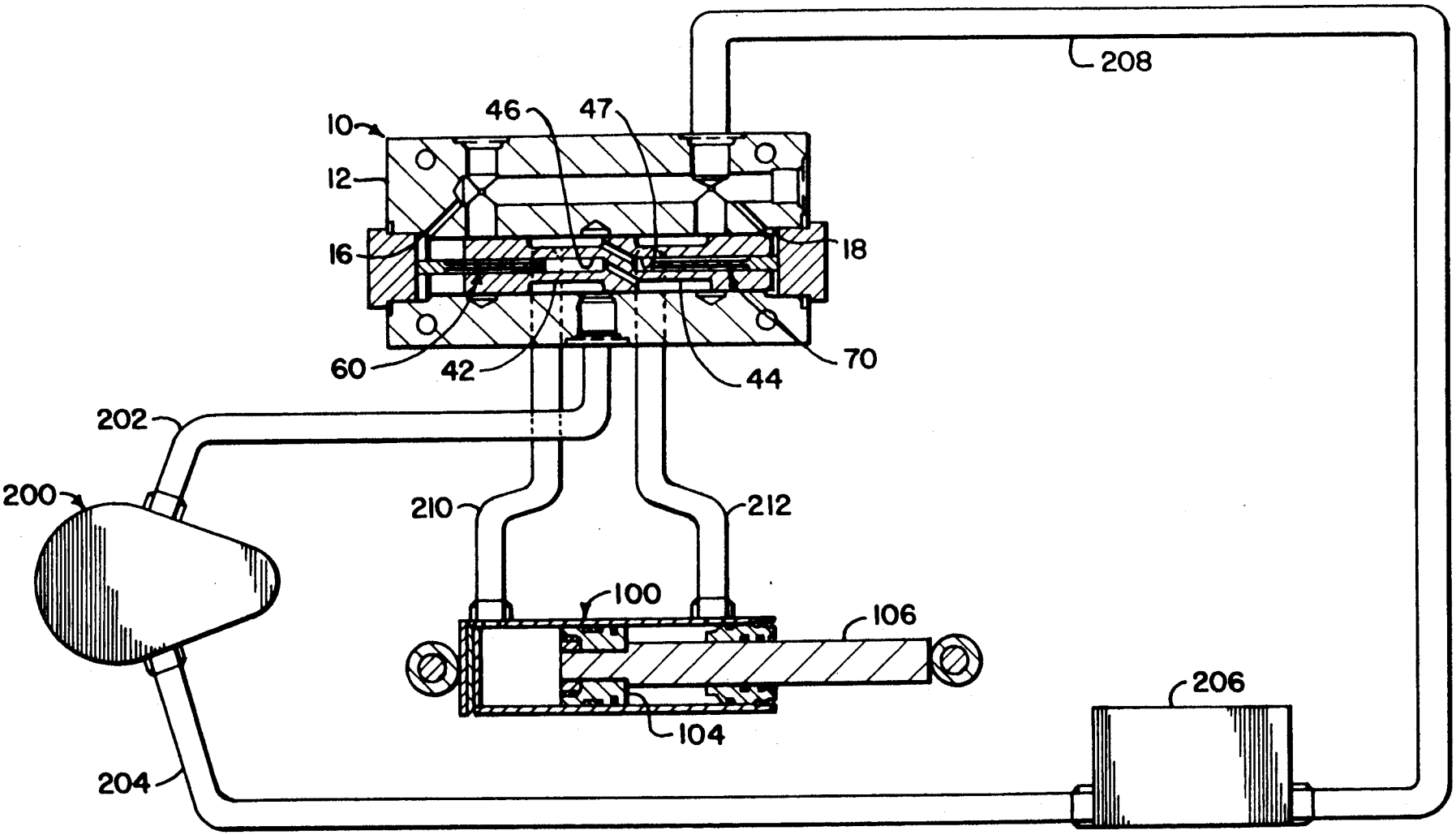
FIG. 2 is a view similar to that shown in FIG. 1, but with the cylinder partially extended.

At the same time, fluid within the cylinder housing 102 on the opposite side of piston 104, essentially in the rod end 108 of the cylinder 100, is connected by conduit 212 to second feed port 24, and then through cavity 44 to second drain port 28. From second drain port 28, hydraulic fluid can flow through conduit 208 to the reservoir or tank 206. As a result, the hydraulic fluid under pressure directed into the blind end 110 of hydraulic cylinder 100 forces piston 104 to move toward the rod end 108, thereby extending the piston rod 106 outwardly from the cylindrical housing 102, as illustrated in FIG. 2.

As the piston 104 moves toward rod end 108, the hydraulic fluid in the rod end of cylinder housing 102 is forced through conduit 212 into the cavity 44 of spool 40. In this condition, the drain port 28 and conduit 208 are basically under no pressure, being connected directly into the reservoir 206. However, the cavity 44 is sized such that fluid flow from cavity 44 into second drain port 28 is restricted, which creates a back pressure in cavity 44. There is a consequent pressure drop or pressure differential between cavity 44 and second drain port 28. This back pressure in cavity 44 is not as high pressure as the pressurized hydraulic fluid from the pump 200 in conduit 202 and 210, but it is higher than the essentially no pressure conduit 208 and tank 206. Therefore, the fluid pressure in conduit 212 and cavity 44 is considered to be in a low pressure condition as compared to the high pressure output of the pump 200.

This same low fluid pressure that is in cavity 44 is communicated through shunt port 50 into control bore 46 in the first end of spool 40, and some hydraulic fluid bleeds from cavity 44 into and through this first control bore 46. The fluid in first control bore 46 continues to flow through fluted passages 66 extending longitudinally along the peripheral surface of an elongated first control valve stem 60, which extends partially into the control bore 46, as illustrated in FIG. 1. From the control bore 46, the low pressure hydraulic fluid continues to flow into the first end 16 of spool bore 14 in valve body 12.

A first bypass port 32 extends from the first end 16 of spool bore 14 into communication with first drain port 26, such that some fluid can bleed from cavity 44 through shunt port 50, first control bore 46, first bypass port 32, and a cross-connecting drain bore 30 into the drain line 208 to flow to tank. However, the bypass port 32 is small enough such that it also holds a partial back pressure in the first end 16 of spool bore 14. This low pressure in the first end 16 of spool bore 14 acts on the first end 41 of spool 40, thereby causing a force to spool 40 in the position shown in FIG. 1.

A second bypass port 34 extending between the second end 18 of spool bore 14 and the second drain port 28 essentially bleeds the second end 18 of spool bore 14 to tank pressure, i.e. virtually no pressure. Therefore, there is no counter pressure in this condition on the second end 43 of spool 40 that could push the spool 40 in the opposite direction.

Figure 3:
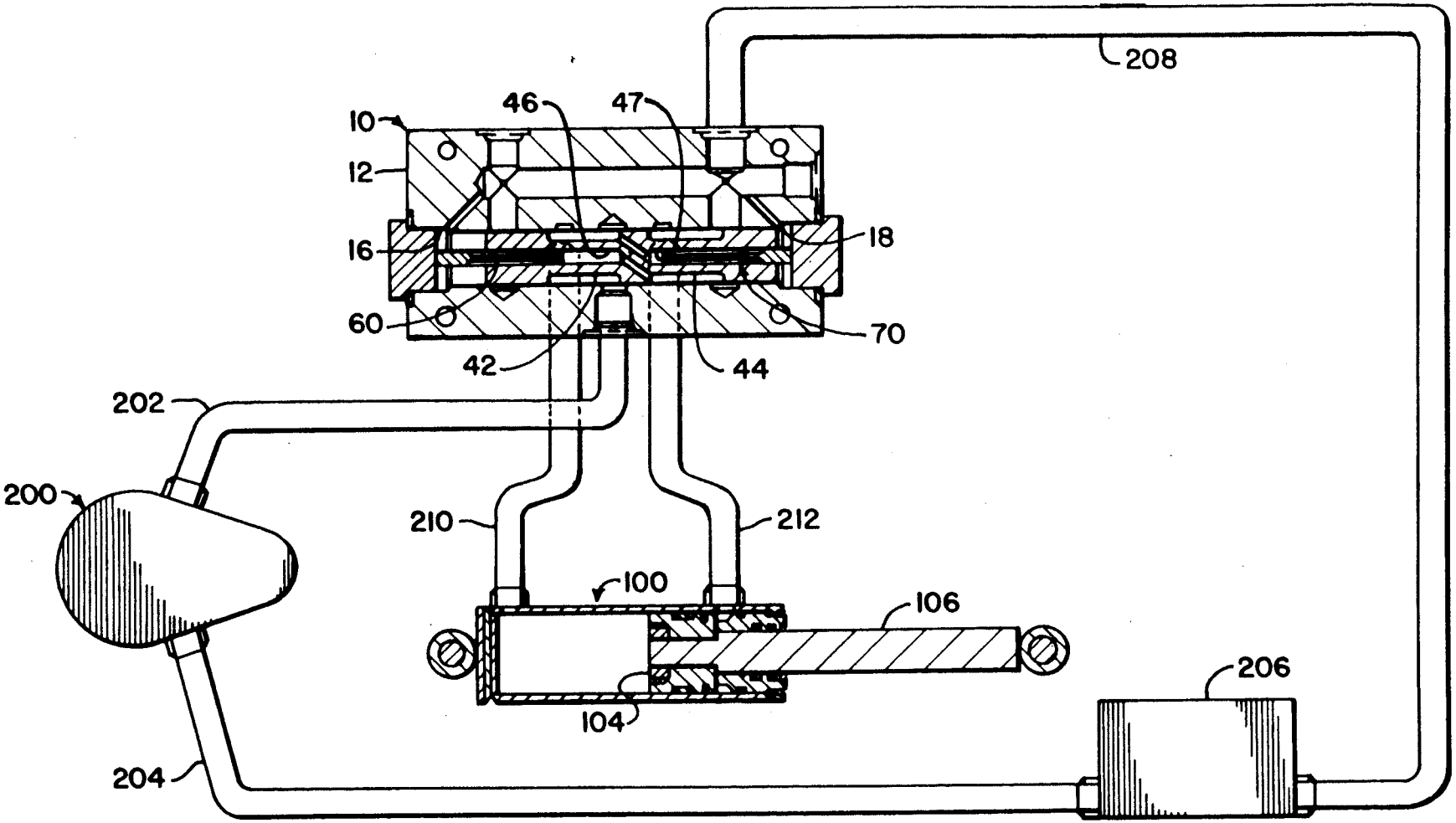
FIG. 3 is a view similar to FIG. 2, but with the cylinder fully extended.

The spool 40 stays in this first position during the entire time that it takes for the hydraulic fluid under pressure from the pump 200 to push the piston 104 all the way to the rod end 108, thereby fully extending the piston 106, as shown in FIG. 3. When the piston reaches the rod end 108, as shown in FIG. 3, such that it cannot move any further in the extended direction, then there is no more hydraulic fluid being forced out of the cylindrical housing 102 and into the cavity 44 of spool 40. Therefore, as soon as this return fluid through cavity 44 stops flowing, the pressure in cavity 44 equalizes with the tank pressure, i.e., drops to essentially no pressure, as is present in drain ports 26 and 28. At the same time, the pressure in the first end 16 of spool bore 14 also equalizes through bypass 32 with drain ports 26 and 28, essentially dropping to nothing.

The high pressure fluid in first cavity 42 is shunted through first shunt port 48 into the second control bore 47 in spool 40. This high pressure fluid in control bore 47 cannot escape control bore 47 into the second end 18 of spool bore 14, because it is blocked by the large diameter first end 72 of second control valve stem 70. Therefore, this high pressure fluid in control bore 47 acts on the spool 40 and forces it to move toward the first end 16 of spool bore 14. It should be noted here that this high pressure fluid was present in second control bore 47 throughout the process described above during extension of the piston 106, but the small diameter of control bore 47 on which this high pressure fluid acts was insufficient to produce a force large enough to overcome the low pressure fluid in first end 16 of spool bore 14 that was acting on the large diameter first end 41 of spool 40.

Figure 4:
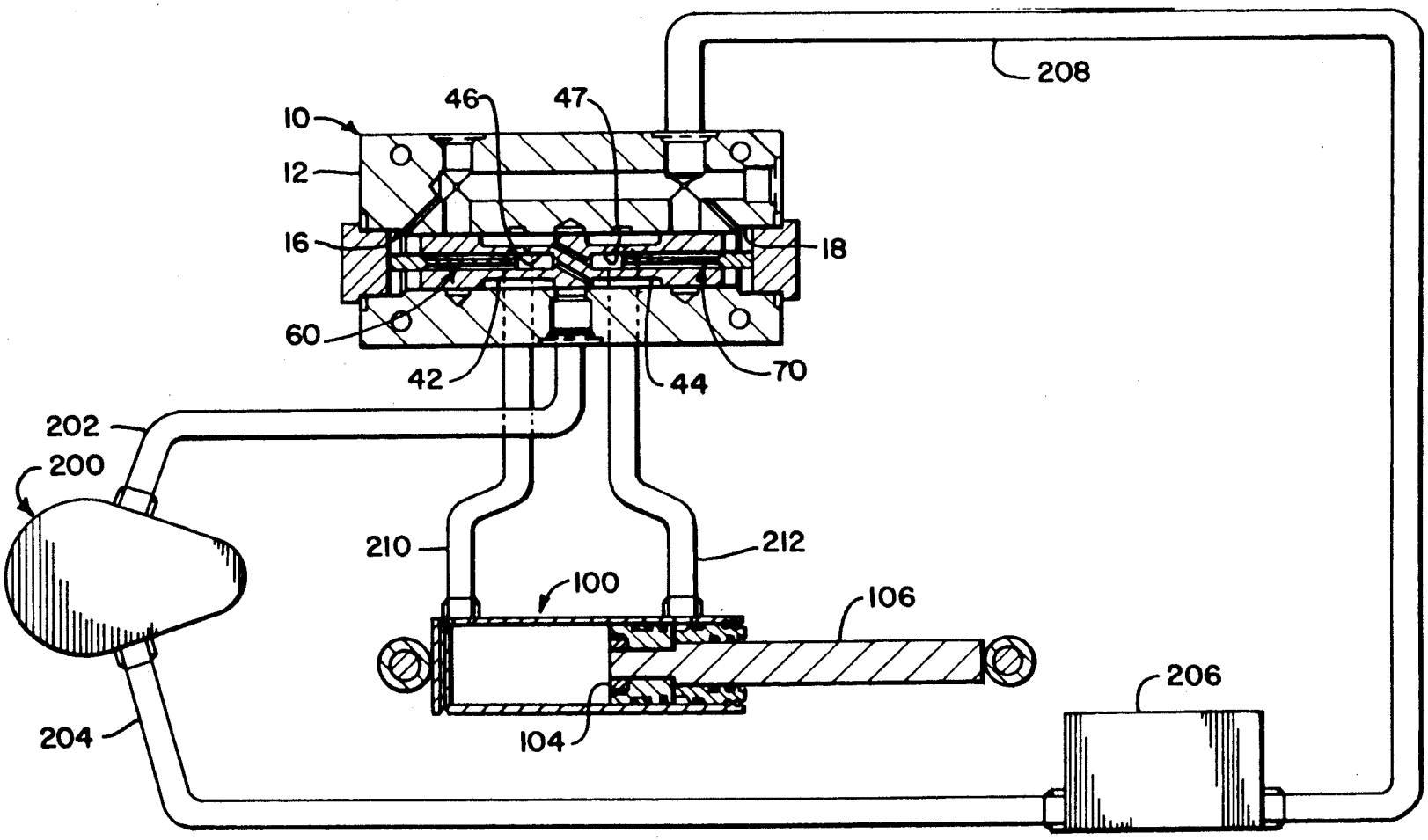
FIG. 4 is a view similar to FIG. 3 with the cylinder fully extended, but with the shuttle spool and the pulsating valve shifted partially toward the second position as it moves to reverse the direction of movement of the cylinder.

With essentially no pressure in the first end 16 of spool bore 14, the high pressure fluid in control bore 47 acts to push the spool 40 toward the first end 16 of spool bore 14, as described above, and as illustrated in FIG. 4. In FIG. 4, the spool 40 is shown moved about half way toward the first end 16 of spool bore 14. In this half-way position, neither cavity 42 nor cavity 44 is in communication with pressure port 20, such that the pressurized fluid from the pump 200 in conduit 202 is effectively closed off by the spool 40. However, the momentum of the spool 40 shifting toward first end 16, as well as other various effects, including residual accumulated pressure in conduits, such as conduit 210, as well as in an accumulator (not shown) if necessary, act to continue the movement of spool 40 beyond this dead zone toward the first end 16 of spool bore 14.

Figure 5:
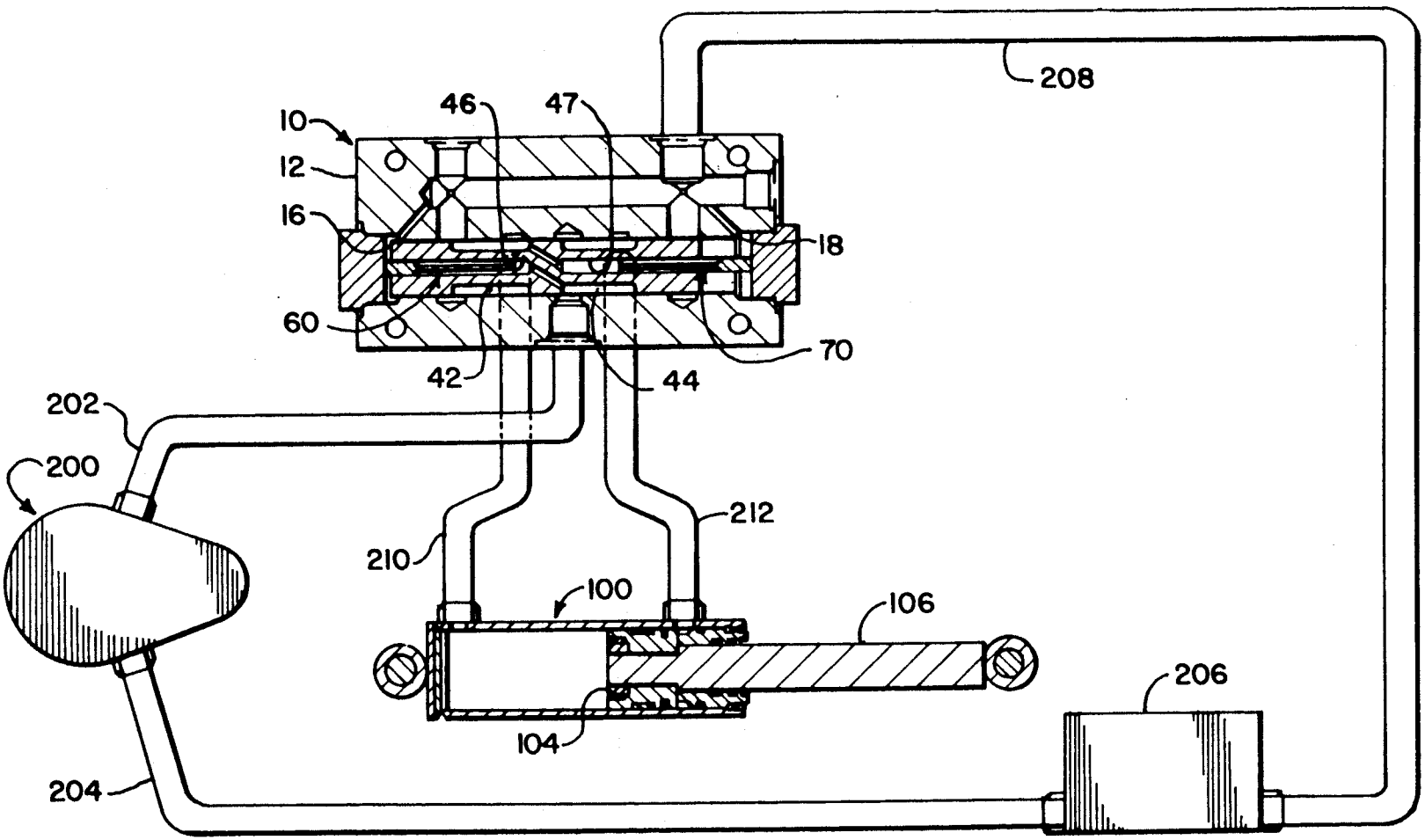
FIG. 5 is a view similar to FIG. 4, but with the shuttle spool fully shifted to the second position such that pressure hydraulic fluid is directed to the cylinder to begin retraction of the piston rod.
Figure 6:
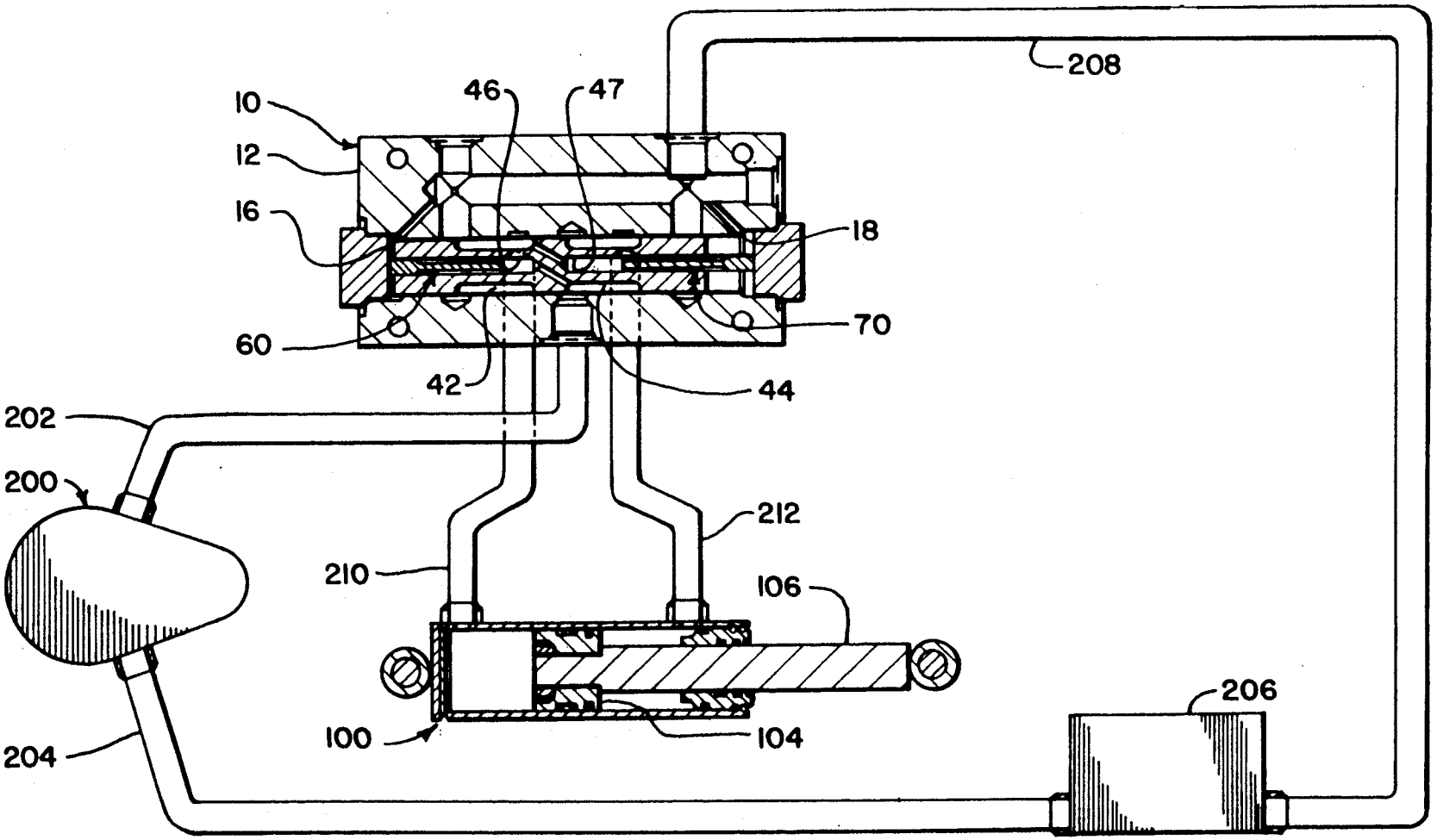
FIG. 6 is a view similar to FIG. 5, but with the cylinder piston partially retracted.

As the spool 40 continues to move toward the second position adjacent the first plug 36, as shown in FIG. 5, the cavity 44 is moved a sufficient distance to span and connect the pressure port 20 with second feed port 24, and first cavity 42 spans and connects first feed port 22 with first drain port 26. In this position, the hydraulic fluid under pressure from pump 200 through conduit 202 is directed through second cavity 44 and through conduit 212 into the rod end 108 of cylinder 100. With the pressure on the rod side of piston 104, the piston 104 is forced to move toward the blind end 110 of cylinder 100, thereby retracting piston rod 106 into the cylindrical housing 102, as illustrated by the partially retracted rod 106 in FIG. 6.

As the piston 104 is forced by high pressure fluid toward the rod end 110, it forces hydraulic fluid from the blind end 110 of cylinder 100 through conduit 212 and first feed port 22 into first cavity 42, where it is directed to first drain port 26. However, as described above for the extension mode, the flow of fluid from first cavity 42 into first drain port 26 is restricted such that a back pressure, i.e. a low pressure volume of hydraulic fluid, is held in cavity 42. This low pressure fluid is communicated through first shunt 48 into second control bore 47 where it forces second control valve stem 70 partially out of the control bore 47 where it abuts against second plug 38. Actually, the second control valve stem 70 more than likely remains substantially stationary in abutment against second plug 18 as the spool 40 moves toward the first end 16 of spool bore 14, as described above, although it is free to float wherever pressure will allow it to move. In any event, when the large first end 72 of control valve stem 70 is pushed out of control bore 47, the low pressure fluid can continue through passages 76 into the second end 18 of spool bore 14 where the low pressure in this second end 18 is applied against the second end 43 of spool 40, tending to push the spool 40 all the way to the first end 16 of spool bore 14.

Again, the second bypass 34 connecting the second end 18 of spool bore 14 to the second drain port 28 is sufficiently small and restricted such that it does not bleed enough of the low pressure out of the first end 18 to prevent this force from moving the spool 40 toward the first end 16. At the same time, the high pressure fluid in second cavity 44 is also communicated through second shunt port 50 into the first control bore 46, where it is blocked by the large first end 62 of first control valve stem 60, which is now forced into the control bore 46 essentially by being abutted against the plug 36 as the spool 40 moves toward the first end 16. Again, while this high pressure in first control bore 46 is higher than the low pressure in second end 18, the diameter of second end 43 of spool 40 is sufficiently large that the force applied to the second end 43 of spool 40 is larger than the oppositely directed force from the high pressure fluid in the smaller diameter control bore 46. The net force effect drives the spool 40 to the first end 16 and holds it there while the rod 106 of cylinder 100 is being retracted into the cylindrical housing 102.

Figure 7:
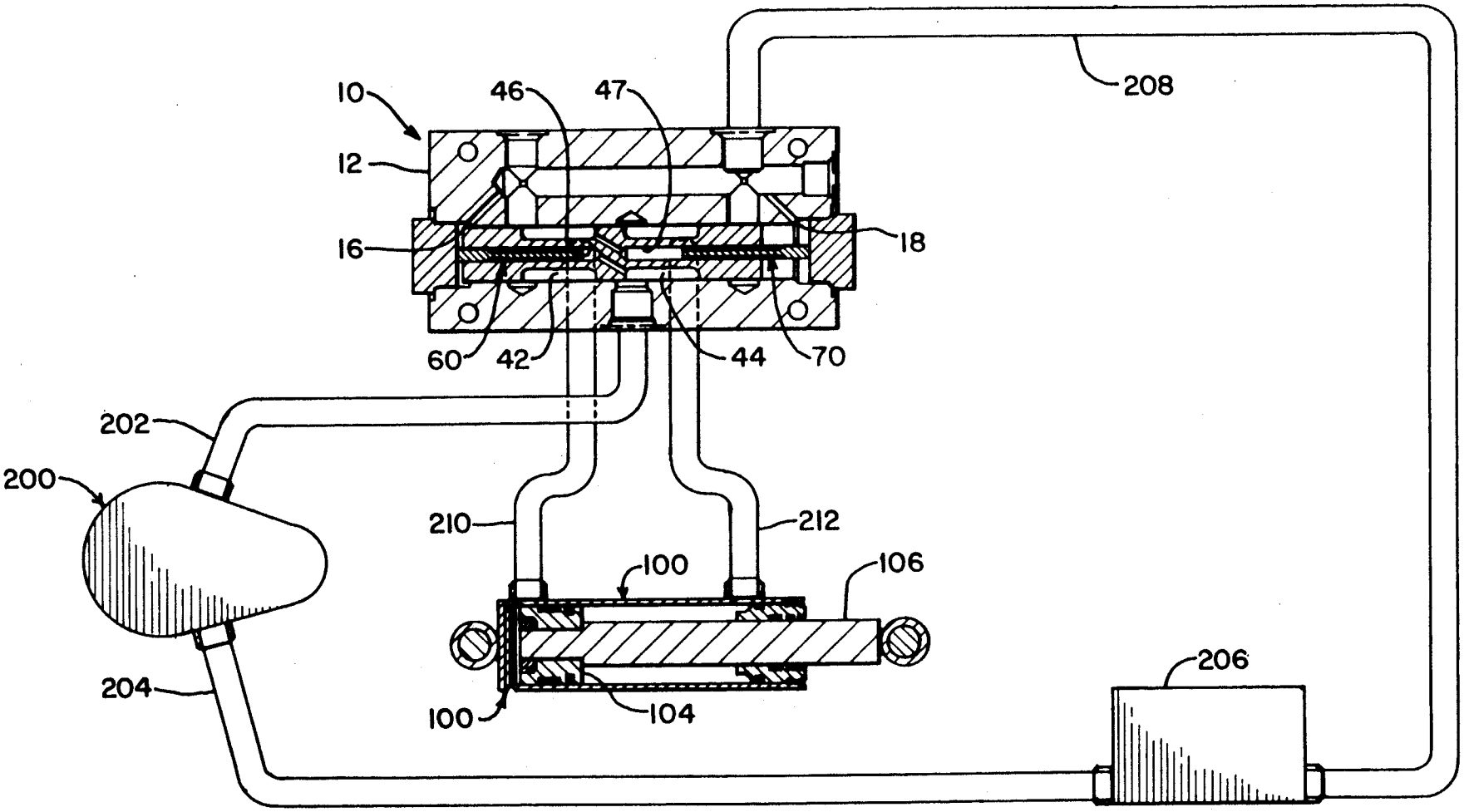
FIG. 7 is a view similar to FIG. 6, but with the piston rod fully retracted.

The above-described spool position and high and low pressure areas are held all the while the high pressure fluid is forcing the piston 104 toward the blind end 110 of cylinder 100, thereby during the full retraction cycle of rod 106, as shown in FIG. 7.

Figure 8:
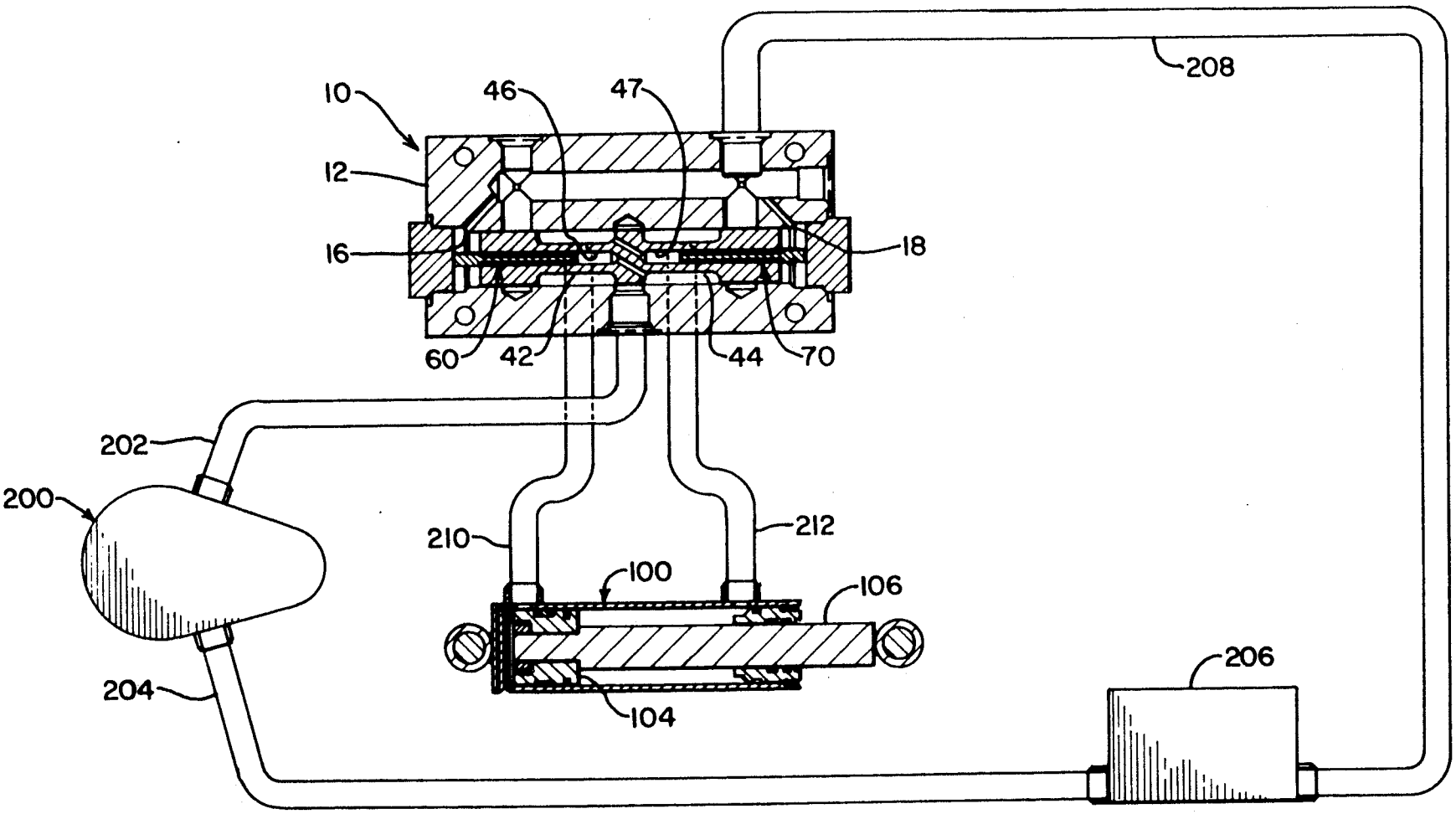
FIG. 8 is a view similar to FIG. 7, but with the shuttle spool shifted partially back toward the first position again.
Figure 9:
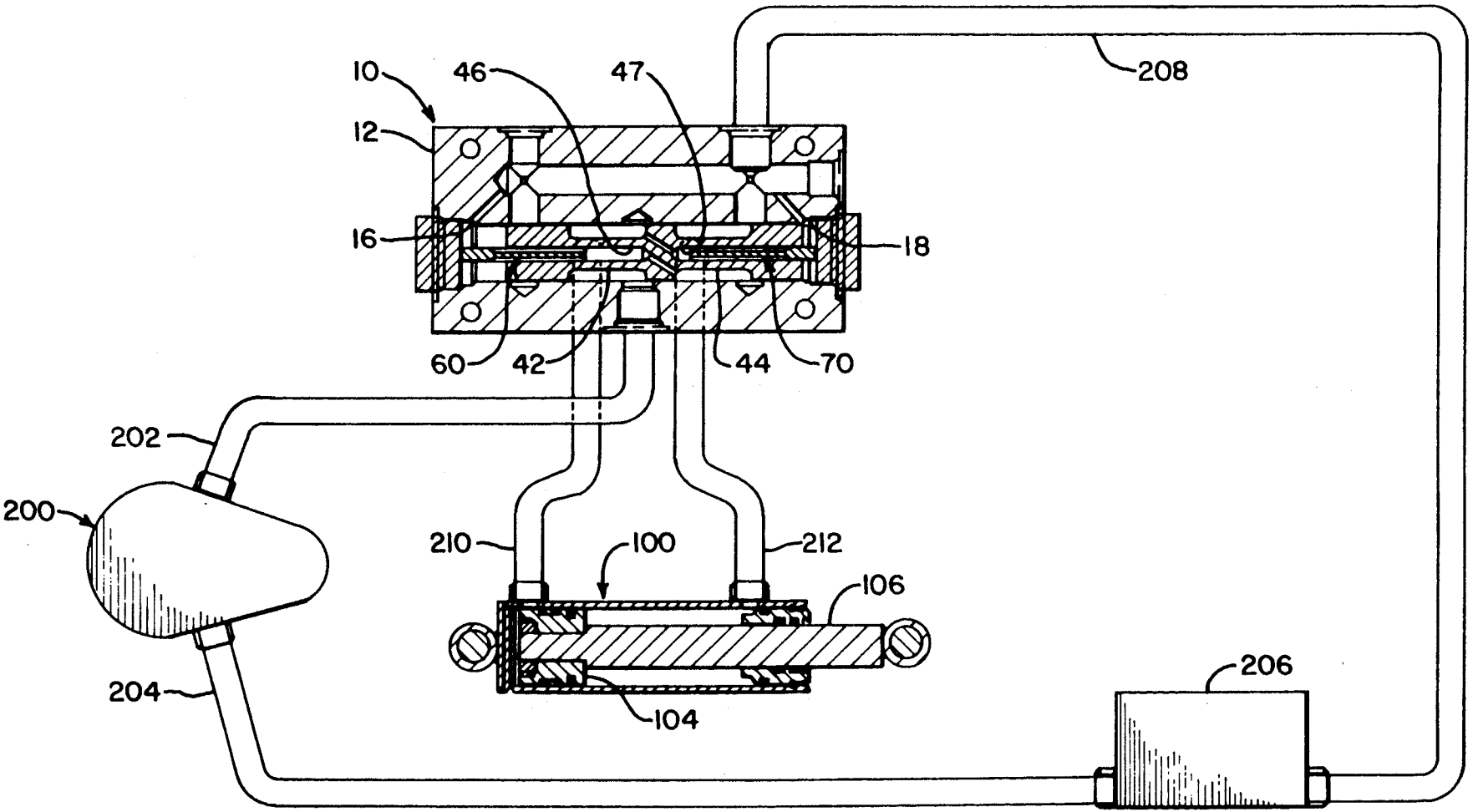
FIG. 9 is a view similar to FIG. 8, but with the shuttle spool shifted fully to the first position again.

When the piston 104 is moved into abutment with blind end 110 such that the rod 106 cannot be retracted any further, the piston 104 can no longer force hydraulic fluid through conduit 210 into cavity 42. Therefore, the low pressure fluid in cavity 42 bleeds to tank pressure through first drain port 26 and second bypass 52. When that low pressure in the second end 18 of spool bore 14 bleeds down enough such that the force of the high pressure fluid in first control bore 46 overcomes the force of the low pressure fluid, or no pressure fluid, in second end 18, the spool 40 is moved in the opposite direction toward second end 18, as illustrated in FIG. 8. This movement of spool 40 toward second end 18 continues, as shown in FIG. 9 where it becomes fully positioned adjacent second end 18, which is essentially the same position as was shown and described in FIG. 1. Therefore, the reciprocal cycle starts over to again extend rod 106 as described above.

It is appropriate to note that it is the lack of movement of piston 104 that causes no return fluid flow, thus consequent shifting of spool 40 between its first and second positions. Therefore, while such stationary piston condition can be caused by the piston reaching the end of its travel in the cylinder housing 102, as described above, it can also be caused by any resistance that is large enough to stop the piston movement. Thus, mechanical movement limitations in whatever apparatus is connected to the rod 106, conventional adjustments for travel limit apparatus for such rods, or even a large load on the rod that the fluid pressure provided by pump 200 or convention pressure relief system (not shown) cannot overcome, can stop the piston 104 movement, thus activate the shuttle of spool 40 between its first and second positions.

This continuous cycling or reciprocating of the rod 106 out of and into the cylindrical housing 102 of cylinder 100 continues as long as hydraulic fluid under pressure is provided by pump 200. The only moving part in the pulsating valve 10 is the reciprocating spool 40 moving back and forth between the first end 16 and the second end 18 of spool bore 14. The first and second control valve stems 60, 70 usually remain essentially stationary, although they effectively move relatively into and out of the control bores 46, 47, as described above. Seals 52, 54, 56 can be provided around the peripheral surface of spool 40 in respective positions on either side of cavities 42, 44.

Figure 10:
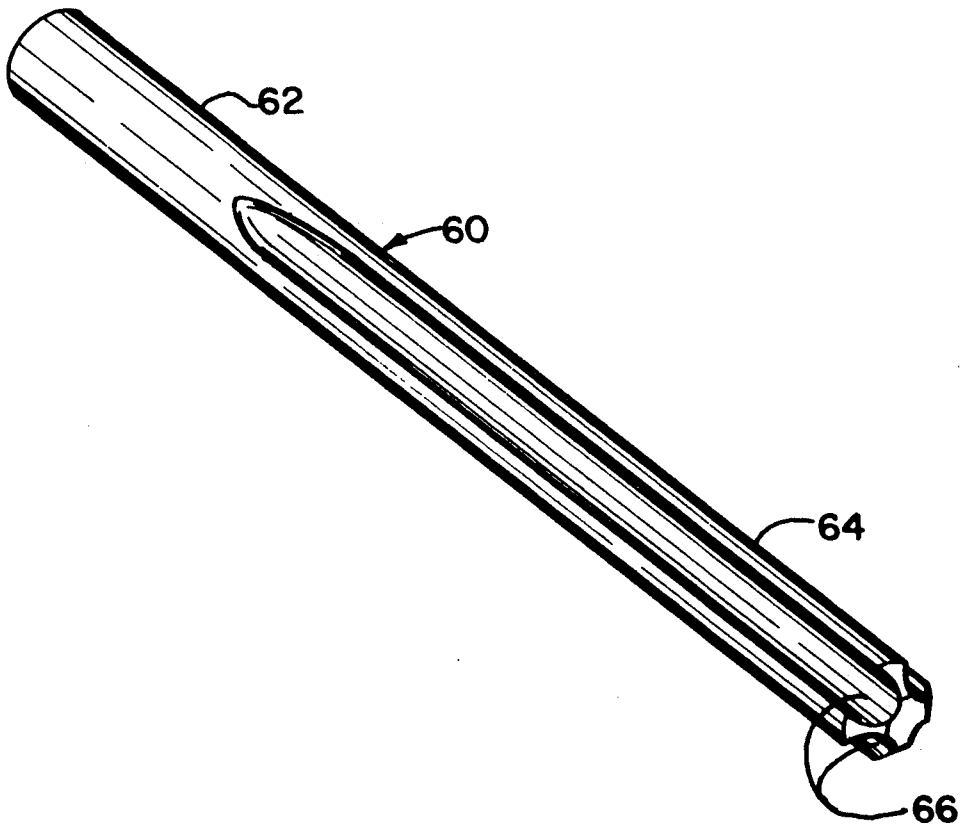
FIG. 10 is an enlarged perspective view of the control valve stem according to the present invention.

The preferred embodiment control valve stem 60 is shown in FIG. 10. It is essentially an elongated, cylindrical body with a large end first end 62 having a diameter approximately the same as the diameter of the control bore 46, allowing tolerances for movement. The second end 64 is preferably fluted to provide a plurality of longitudinal passages 66 in its peripheral surface to facilitate the flow of fluid through control conduit 46 when the larger first end 62 is not positioned in the conduit 46. Of course, as described above, when the large end 62 of control valve stem 60 is pushed into the control bore 46, the flow of fluid therethrough is prohibited.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention as defined by the claims which follow.

The embodiment of the invention in which an exclusive property or privilege is claimed are defined as follows:

1. Pulsating hydraulic valve apparatus for directing flow of hydraulic fluid in a manner to control operation of a hydraulic cylinder, comprising:

a valve body having an elongated spool bore therein with a longitudinal axis that defines a longitudinal axis of the valve and having a first end and a second end, a pressure port extending transversely through said valve body into said spool bore, a first feed port and a second feed port, each of which extends transversely through said valve body into said spool bore at longitudinally short spaced distances on longitudinally opposite sides of said pressure port, a first drain port and a second drain port, each of which extends transversely through said valve body into said spool bore at longitudinally long spaced distances on longitudinally opposite sides of said pressure port, wherein said longitudinally long spaced distances are greater than said longitudinally short spaced distances, a first bypass port extending between and connecting said first end of said spool bore and said first drain port, a second bypass port extending between and connecting said second end of said spool bore and said second drain port, first plug means for closing said first end of said spool bore, and second plug means for closing said second end of said spool bore;

an elongated shuttle spool having a first end and a second end positioned slideably in said spool bore and moveable longitudinally between a first position and a second position in said spool bore, said shuttle spool being longer than the distance between said first and second drain ports but shorter than said spool bore, said shuttle spool also having a diameter large enough to substantially fill said spool bore, but also having a first cavity and a second cavity, each of which first and second cavities is depressed into the peripheral surface of the shuttle spool a sufficient amount to allow fluid to flow in said first and second cavities between said spool and said valve body, said first cavity being long enough and positioned such that it spans and connects said pressure port and said first feed port when said spool is in said first position and such that it spans and connects said first feed port and said first drain port when said spool is in said second position, said second cavity being long enough and positioned such that it spans and connects said second feed port and said second drain port when said spool is in said first position and such that it connects said pressure port and said second feed port when said spool is in said second position, said spool also having a first control bore extending longitudinally therein from said first end of said spool and a second control bore extending longitudinally therein from said second end of said spool, a first shunt port extending from said first cavity to said second control bore, and a second shunt port extending from said second cavity to said first control bore;

first control valve means positioned in said first control bore for blocking fluid flow through said first control bore to said first end of said spool bore to move said spool toward said first position and alternately for allowing fluid flow through said first control bore when said spool moves toward said second position; and second control valve means positioned in said second control bore for blocking fluid flow through said second control bore to said second end of said spool bore to move said spool toward said second position and alternately for allowing fluid flow through said second control bore when said spool moves toward said first position.

2. The pulsating hydraulic valve apparatus of claim 1, wherein said first control valve means includes a first elongated control valve stem having a first end and a second end slideably positioned in said first control bore, said first end of said first control valve stem having a diameter large enough to substantially prohibit fluid flow through said first control bore when it is positioned in said first control bore, and said second end of said first control valve stem having a passage therein for allowing fluid flow through said first control bore when said first end of said first control valve stem is not positioned in said first control bore, and wherein said second control valve means includes a second elongated control valve stem having a first end and a second end slideably positioned in said second control bore, said first end of said second control valve stem having a diameter large enough to substantially prohibit fluid flow through said second control bore when it is positioned in said second control bore, and said second end of said second control valve stem having a passage therein for allowing fluid flow through said second control bore when said first end of said second control valve stem is not positioned in said second control bore.

3. The pulsating hydraulic valve apparatus of claim 2, wherein said first end of said first control valve stem is abutable against said first plug means and said first end of said second control valve stem is abutable against said second plug means.

4. The pulsating hydraulic valve apparatus of claim 3, wherein said spool is moveable a sufficient distance in said spool bore such that movement toward said first position allows said first end of said first control valve stem to move out of said first control bore and causes said first end of said second control valve stem to move into said second control bore and such that movement toward said second position allows said first end of said second control valve stem to move out of said second control bore and causes said first end of said first control valve stem to move into said first control bore.

5. The pulsating hydraulic valve apparatus of claim 4, wherein said respective second ends of said first and second control valve stems are fluted with at least one elongated recess extending longitudinally along its peripheral surface.

* * * * *